United States Patent [19]

Bonser et al.

[11] Patent Number: 4,684,596

[45] Date of Patent: Aug. 4, 1987

[54] ELECTROGRAPHIC TONER AND DEVELOPER COMPOSITION CONTAINING QUATERNARY AMMONIUM SALT CHARGE-CONTROL AGENT

[75] Inventors: Steven M. Bonser; Douglas E. Bugner; Lawrence P. Demejo, all of Rochester, N.Y.

[73] Assignee: Eastman Kodak Company, Rochester, N.Y.

[21] Appl. No.: 829,878

[22] Filed: Feb. 18, 1986

[51] Int. Cl.[4] ..... G03G 9/10

[52] U.S. Cl. ..... 430/110; 430/126

[58] Field of Search ..... 430/99, 120, 124, 126, 430/110

[56] References Cited

U.S. PATENT DOCUMENTS

| | | | |
|---|---|---|---|
| 3,976,485 | 8/1976 | Groner | 430/38 |
| 4,338,390 | 7/1982 | Lu | 430/106 |
| 4,394,430 | 7/1983 | Jadwin et al. | 430/110 |
| 4,460,672 | 7/1984 | Gruber et al. | 430/110 |
| 4,496,643 | 1/1985 | Wilson et al. | 430/110 |
| 4,578,338 | 3/1986 | Gruber et al. | 430/120 |

*Primary Examiner*—John L. Goodrow

*Attorney, Agent, or Firm*—Robert A. Gerlach

[57] ABSTRACT

The present invention relates to the use of quaternary ammonium salt as a charge-control agent for electrostatic toner contained in a dry developer composition. The dry, particulate, electrostatic toner composition of the present invention comprises (a) a polymeric binder and (b) a charge-control agent comprising an N-benzyl quaternary ammonium salt, wherein the benzyl ring contains at least one substituent with a Hammett substituent constant that is greater than zero.

14 Claims, 2 Drawing Figures

ELECTROGRAPHIC TONER AND DEVELOPER COMPOSITION CONTAINING QUATERNARY AMMONIUM SALT CHARGE-CONTROL AGENT

FIELD OF THE INVENTION

This invention relates to electrography and in particular to a charge agent for use in a toner composition, and a dry electrographic developer composition containing said toner.

BACKGROUND OF THE INVENTION

Electrophotographic imaging processes have been described extensively in patents and other literature. These processes have in common the forming of an electrostatic charge pattern on an insulating photoconductor. The pattern, or latent electrostatic image, is made visible by contact with a developer containing electrostatically charged toner powder. Several methods of dry development are available, including the well known magnetic brush and cascade development methods. Many dry developers are a mixture of toner particles and carrier particles. For magnetic brush development, the latter can be a magnetic substance such as iron filings, iron powder or iron oxide. For cascade development and other methods the carrier particles can be non-magnetic substances such as glass or ceramic beads. The toner particles become triboelectrically charged by frictional contact with the carrier particles. Then, when contacted with the oppositely charged image pattern on the photoconductor, they adhere to the charged areas and make the image visible. In well-known office copying machines, the developed toner image is transferred from the photoconductor to a receiver sheet, e.g., plain paper, to which it is fixed by fusion or other known techniques.

While polymeric binder is a major component of the toner, certain addenda usually are dispersed in the polymer. These can include one or more colorants such as pigments and dyestuffs which make the developed charge pattern visible. Also desirable as addenda are compounds which help to maintain a uniform, stable, high net electrical charge on the triboelectrically charged toner particles. These compounds are known as charge-control agents.

A variety of charge-control agents for dry toner particles have been proposed. For example Jadwin U.S. Pat. No. 4,394,430 issued July 19, 1983 (which is herein incorporated by reference in its entirety) describes an electrostatic toner containing alkyldimethylbenzylammonium salts of the formula

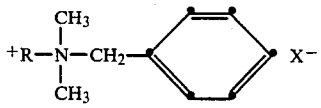

wherein R is an alkyl group of from 12 to 24 carbon atoms and $X^-$ is an anion. These quaternary ammonium salts provide high uniform net electrical charge to a toner powder without reducing the adhesion of the toner to paper. In addition, they are versatile in their utility and toner compositions into which they are incorporated form good to excellent images. Furthermore, the fact that this type of compound is so mild that it has been used in skin lotions and therefore presents substantially no risk of skin irritation provides another advantage.

However, the quaternary ammonium salts disclosed in U.S. Pat. No. 4,394,430 have been found to be thermally labile, producing reactive by-products such as acids, olefins, amines, and organic halides when heated. These by-products may contribute to deleterious side effects as well as adversely affecting the triboelectrical behavior of the toner particles. For instance, by-products such as benzyl chloride, methyl chloride and amine hydrochloride are not effective charge-control agents. Therefore, degradation of the original charge-control agent into such reactive by-products reduces the effectiveness of the charge-control agent. The problem is especially vexing because many prior art quaternary ammonium salts are also very sensitive to their environment in the toner (e.g., humidity, chemical species, etc.) and to compounding conditions. As a result, it is difficult to control the extent of degradation, which leads to unpredictable changes in charge-control effectiveness.

SUMMARY OF THE INVENTION

The present invention provides an improved dry electrostatic toner composition which employs as a charge-control agent a type of quaternary ammonium salt. It has unexpectedly been found that a charge control agent of the type described in U.S. Pat. No. 4,394,430, when modified by incorporation of certain substituents on the benzyl ring therein, provides improved charge-control agents which exhibit significantly increased thermal stability.

The improved toner composition of the present invention comprises (a) a polymeric binder and (b) a charge-control agent comprising an N-benzyl quaternary ammonium salt, wherein the benzyl ring contains at least one substituent with a Hammett substituent constant that is greater than zero.

The developer composition of the invention comprises toner particles, as described above, and optionally, carrier particles. In an alternative embodiment, the toner of the present invention may be used in a single component developer.

DETAILED DESCRIPTION

Figure 1:
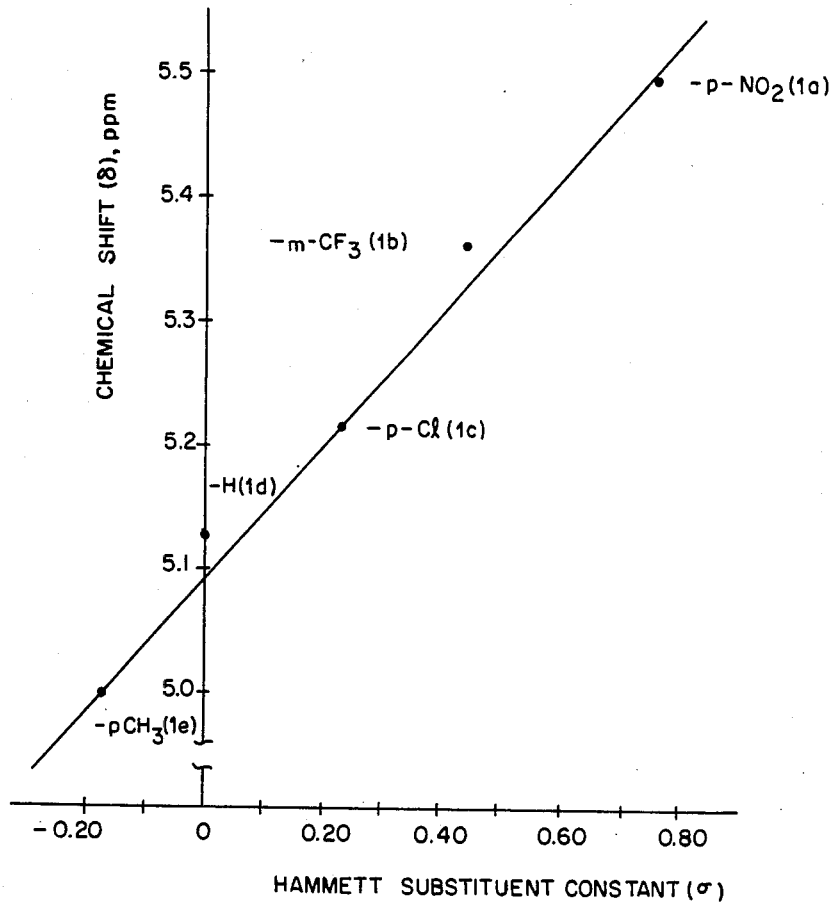
FIG. 1 is a graph which correlates the chemical shift ($\delta$) (relative to tetramethylsilane) of the benzyl methylene protons in N-benzyl quaternary ammonium salts to the Hammett substituent constant ($\sigma$).

In accordance with the present invention, certain quaternary ammonium salts are incorporated into a dry particulate toner composition comprising a polymeric binder and, if desired, a suitable colorant such as a pigment or dye. The salts provide an effective charge-control agent for the toner composition.

The charge-control agent comprises an N-benzyl quaternary ammonium salt wherein the benzyl group contains an electronegative substituent. The electronegativity of the substituent is measured relative to the unsubstituted derivative (substituent=H) by using the well-known Hammett substituent constant ($\sigma$). (L. P. Hammett, Chem. Revs., 17, 125 (1935). By definition $\sigma$ for hydrogen is zero; substituents with $\sigma$ greater than zero are more electronegative, while substituents with $\sigma$ less than zero are less electronegative than hydrogen. For the quaternary ammonium salt of the present invention, a convenient technique for measuring the relative electronegativity of a substituent is to record the $^1H$ nuclear magnetic resonance spectrum. The chemical shift ($\delta$) (relative to an internal standard such as tetramethylsilane) of the benzyl methylene protons can be correlated to the above-mentioned substituent constant ($\sigma$) as demonstrated in FIG. 1. Thus benzyl ring substituents with values of $\delta$ for the benzyl methylene proton which are greater than that observed for the unsubstituted benzyl ring (substituent = H) are more electronegative than H, and substituents with values of $\delta$ less than that observed for H are less electonegative than H.

Examples of the quaternary ammonium salts useful in the present invention are materials having the following formula:

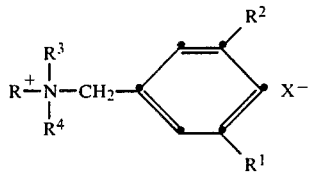

wherein R is hydrogen, a straight or branched chain alkyl group having 12 to 24 carbon atoms, an aryl group or a substituted aryl group; $R^1$ is $NO_2$, CN, $CF_3$, $CH_3CO$, halide or any substituent with $\sigma > O$; $R^2$ is H or a substituent with $\sigma > O$; $R^3$ and $R^4$, which may be the same or different, are lower alkyls; or, when taken together, R, $R^3$ And $R^4$ form a ring system; and $X^-$ represents an anion.

A variety of conventional anions can be utilized for $X^-$, including the following: halides such as chloride, bromide, or iodide; tetrafluoroborate; hexafluorophosphate; acetate; carboxylate; benzoate; trimellitate; phosphomolybdate; thiocyanate; tetraphenylborate; perchlorate; nitrate and organo-sulphur-containing anions of the formula $R^5SO_n$ wherein $R^5$ is a fluorocarbon, an aliphatic group or an aromatic group having up to about 10 carbon atoms and n is 3 or 4 (e.g. p-toluenesulfonate, benzene sulfonate, dimethylbenzene sulfonate, 3-nitrobenzene sulfonate or trifluoromethane sulfonate).

The quaternary ammonium salt charge-control agents used in the practice of the present invention, when incorporated in a toner, have been found suprisingly effective in providing a particulate toner composition which exhibits a relatively high, uniform and stable net toner charge and a minimal amount of deleterious toner throw-off when admixed with a suitable particulate carrier vehicle. Most importantly, the charge-control agent used in the present invention have been found to exhibit improved thermal stability. This is important because charge-control agents may be exposed to relatively high temperatures during the compounding of the toner and within the copier apparatus itself. Quaternary ammonium salts of the prior art have been found to be thermally labile, producing reactive by-products such as acids, olefins, amines, and organic halides. These by-products may contribute to deleterious side effects (e.g. higher toner throw-off) as well as adversely affecting the triboelectric behavior of the toner particles. The substituted charge-control agents used in the present invention exhibit improved thermal stability relative to the compounds disclosed in U.S. Pat. No. 4,394,430 and provide toners with desirable triboelectric behavior and fusibility.

The mechanism of the thermal degradation of quaternary ammonium compounds is not fully understood. While the inventors do not wish to be bound by any one hypothesis, the mechanism of thermal degradation can be postulated as shown in Equation I, below, for the compounds of U.S. Pat. No. 4,394,430.

Equation I

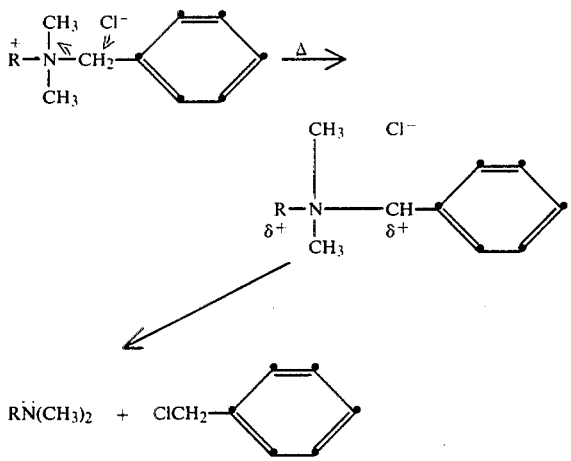

Heterolysis of the benzyl-nitrogen bond would lead to a build-up of positive charge at the benzyl position, followed by transfer of chloride ion to give benzyl chloride. If this mechanism is operative, then substituents on the benzyl ring which tend to destabilize the build-up of positive charge on the methylene group should afford increased thermal stability.

It has been found that suitable polymers containing an effective amount of the quaternary ammonium charge-control agents used in the present invention provide toner particles with improved thermal stability, and result in good to excellent electrographic developed images over a wide ambient temperature range.

The polymers useful in the practice of the present invention can be used alone or in combination and include those polymers conventionally employed in electrostatic toners. Useful polymers generally have a glass transition temperature within the range of from 50° to 120° C. Preferably, toner particles prepared from these polymers have relatively high caking temperature, for example, higher than about 60° C., so that the toner powders may be stored for relatively long periods of time at fairly high temperatures without having individual particles agglomerate and clump together. The melting point of useful polymers preferably is within the range of from about 65° C. to about 200° C. so that the toner particles can readily be fused to a conventional paper receiving sheet to form a permanent image. Especially preferred polymers are those having a melting point within the range of from about 65° to about 120° C. Of course, where other types of receiving elements are used, for example, metal plates such as certain printing plates, polymers having a melting point and glass transition temperature higher than the values specified above may be used.

Among the various polymers which may be employed in the toner particles of the present invention are polycarbonates, resin-modified maleic alkyd polymers, polyamides, phenol-formaldehyde polymers and various derivatives thereof, polyester condensates, modified alkyd polymers, aromatic polymers containing alternating methylene and aromatic units such as described in U.S. Pat. No. 3,809,554 and fusible cross-linked polymers as described in Jadwin et al, U.S. Pat. No. Re. 31,072.

Typical useful toner polymers include certain polycarbonates such as those described in U.S. Pat. No. 3,694,359 issued Sept. 26, 1972, which include polycarbonate materials containing an alkylidene diarylene moiety in a recurring unit and having from 1 to about 10 carbon atoms in the alkyl moiety. Other useful polymers having the above-described physical properties include polymeric esters of acrylic and methacrylic acid such as poly(alkylacrylate), including poly(alkylmethacrylate) wherein the alkyl moiety can contain from 1 to about 10 carbon atoms. Additionally, other polyesters having the aforementioned physical properties are also useful. Among such other useful polyesters are copolyesters prepared from terephthalic acid including substituted terephthalic acid, a bis(hydroxyalkoxy)phenylalkane having from 1 to 4 carbon atoms in the alkoxy radical and from 1 to 10 carbon atoms in the alkane moiety and including such halogen-substituted alkanes, and an alkylene glycol having from 1 to 4 carbon atoms in the alkylene moiety.

Other useful polymers are various styrene-containing polymers. Such polymers typically comprise a polymerized blend of from about 40 to about 100 percent by weight of styrene, from 0 to about 45 percent by weight of a lower alkyl acrylate or methacrylate having from 1 to about 4 carbon atoms in the alkyl moiety such as methyl, ethyl, isopropyl, butyl, etc. and from about 5 to about 50 percent by weight of another vinyl monomer other than styrene, for example, a higher alkyl acrylate or methacrylate having from about 6 to 20 or more carbon atoms in the alkyl group. Typical styrene-containing polymers prepared from a copolymerized blend as described hereinabove are copolymers prepared from a monomeric blend of 40 to 60 percent by weight styrene or styrene homolog, from about 20 to about 50 percent by weight of a lower alkyl acrylate or methacrylate and from about 5 to about 30 percent by weight of a higher alkyl acrylate or methacrylate such as ethylhexyl acrylate (e.g. styrene-butylacrylate copolymer). Preferred fusible styrene copolymers are those which are covalently cross-linked with a small amount of a divinyl compound such as divinylbenzene. A variety of other useful styrene-containing toner materials are disclosed in the following U.S. Pat. Nos.: 2,917,460 issued Dec. 15, 1959; Re. 25,136 issued Mar. 13, 1962; 2,788,288 issued Apr. 9, 1957; 2,638,416 issued Apr. 12, 1953; 2,618,552 issued Nov. 18, 1952 and 2,659,670 issued Nov. 17, 1953.

The toner particles of the present invention can be prepared by various methods. One convenient technique for preparing these toners is spray-drying. Spray-drying involves dissolving the polymer and adding the toner colorant and charge-control agent to a volatile organic solvent such as dichloromethane. This solution is then sprayed through an atomizing nozzle using a substantially nonreactive gas such as nitrogen as the atomizing agent. During atomization, the volatile solvent evaporates from the airborne droplets, producing toner particles of the uniformly dyed or pigmented polymer. The ultimate particle size is determined by varying the size of the atomizing nozzle and the pressure of the gaseous atomizing agent. Particles of a diameter between about 0.1 micron and about 100 microns may be used, although in general present day office copy devices typically employ particles between about 1.0 and 30 microns. However, larger particles or smaller particles can be used where desired for particular methods of development or particular development conditions. For example, in powder cloud development such as described in U.S. Pat. No. 2,691,345 issued Oct. 12, 1954, extremely small toner particles are used.

Another convenient method for preparing the toner composition of the present invention is melt-blending. This technique involves melting a powdered form of polymer or resin and mixing it with suitable colorants, such as dyes or pigments, and the charge-control agent. The polymer can readily be melted on heated compounding rollers which are also useful to stir or otherwise blend the polymer and addenda so as to promote the complete intermixing of these various ingredients. After thorough blending, the mixture is cooled and solidified. The resultant solid mass is then broken into small particles and finely ground to form a free-flowing powder of toner particles.

As described hereinabove the quaternary ammonium charge-control agents of the invention are added to the polymeric toner composition in an amount effective to improve the charge properties of the toner composition. The addition of a charge-control agent improves the charge uniformity of a particular toner composition, i.e., provides a toner composition in which all or substantially all of the individual discrete toner particles exhibit a triboelectric charge of the same sign (negative or positive), maintains a stable, net electrical charge on the toner particles during the process of continuous development and replenishment, and minimizes the amount of "toner throw-off" of a given toner composition. As used herein, the phrases "net electrical charge exhibited by a toner" and "net toner charge" are equivalent and are defined as the total electrical charge exhibited by a specified amount of a particular toner when admixed with a specified amount of a particular carrier vehicle. Although the phenomenon by which such an electrical charge is imparted is not fully understood, it is believed to be due to the triboelectric effect caused by the frictional contact between toner and carrier. As used herein, the term "toner throw-off" is defined as the amount of toner powder thrown out of a developer mix as it is mechanically agitated, e.g., in a development apparatus. Aside from the extraneous contamination problems inherent with airborne toner dust in the development apparatus, toner throw-off also leads to imaging problems such as unwanted background and scumming of the electrographic image-bearing element.

Generally, it has been found desirable to add from about 0.05 to about 6 parts and preferably 0.05 to about 2.0 parts by weight of the aforementioned quaternary ammonium salts per 100 parts by weight of a polymer to obtain the improved toner composition of the present invention. Although larger and smaller amounts of a charge-control agent may be added, it has been found that if amounts much lower than those specified above are utilized, the charge-control agent tends to exhibit little or substantially no improvement in the properties of the toner composition. As amounts more than about 6 parts of charge-control agent per 100 parts of polymeric binder are added, it has been found that the net toner charge exhibited by the resultant toner composition tends to be reduced. Of course, it must be recognized that the optimum amount of charge-control agent to be added will depend, in part, on the particular quaternary ammonium charge-control agents selected and the particular polymer to which it is added. However, the amounts specified hereinabove are typical of the useful range of charge-control agent utilized in conventional dry toner materials.

A variety of colorant materials selected from dyestuffs or pigments may be employed in the toner materials of the present invention. Such materials serve to color the toner and/or render it more visible. Of course, suitable toner materials having the appropriate charging characteristics can be prepared without the use of a colorant material where it is desired to have a developed image of low optical density. In those instances where it is desired to utilize a colorant, the colorants used, can, in principle, be selected from virtually any of the compounds mentioned in the Colour Index Volumes 1 and 2, Second Edition.

Included among the vast number of useful colorants would be such materials as Hansa Yellow G (C.I. 11680), Nigrosine Spirit soluble (C.I. 50415) Chromogen Black ETOO (C.I. 45170), Solvent Black 3 (C.I. 26150), Fuchsine N (C.I. 42510). C.I. Basic Blue 9 (C.I. 52015). Carbon black also provides a useful colorant. The amount of colorant added may vary over a wide range, for example, from about 1 to about 20 percent of the weight of the polymer. Particularly good results are obtained when the amount is from about 2 to about 10 percent.

The toners of this invention can be mixed with a carrier vehicle to form developing compositions. The carrier vehicles which can be used with the present toners to form new developer compositions can be selected from a variety of materials. Suitable carrier vehicles useful in the invention include various nonmagnetic particles such as glass beads, crystals of inorganic salts such as sodium or potassium chloride, hard resin particles, and metal particles.

In addition, magnetic carrier particles can be used in accordance with the invention. Suitable magnetic carrier particles are particles of ferromagnetic materials such as ferrites, iron, cobalt, nickel, and alloys and mixtures thereof. Other useful magnetic carriers are ferromagnetic particles overcoated with a thin layer of various film-forming polymers, for example, the alkali-soluble carboxylated polymers. Other useful resin coated magnetic carrier particles include carrier particles coated with various fluorocarbons such as polytetrafluoroethylene, polyvinylidene fluoride, and mixtures thereof including copolymers of vinylidene fluoride and tetrafluoroethylene.

A typical developer composition containing the above-described toner and a carrier vehicle generally comprises from about 1 to about 10 percent by weight of particulate toner particles and from about 90 to about 99 percent by weight carrier particles. Typically the carrier particles are larger than the toner particles. Conventional carrier particles have a particle size on the order of from about 20 to about 1200 microns, preferably 30–300 microns.

Alternatively, the toners of the present invention may be used in a single component developer, i.e. with no carrier particles.

The toner and developer compositions of this invention can be used in a variety of ways to develop electrostatic charge patterns or latent images. Such developable charge patterns can be prepared by a number of means and be carried for example, on a light sensitive photoconductive element or a non-light sensitive dielectric-surfaced element such as an insulator-coated conductive sheet. One suitable development technique involves cascading the developer composition across the electrostatic charge pattern, while another technique involves applying toner particles from a magnetic brush. This latter technique involves the use of a magnetically attractable carrier vehicle in forming the developer composition. After imagewise deposition of the toner particles, the image can be fixed, e.g. by heating the toner to cause it to fuse to the substrate carrying the toner. If desired, the unfused image can be transferred to a receiver such as a blank sheet of copy paper and then fused to form a permanent image.

The following examples are included for a further understanding of the invention. Although chloride is the anion used in these examples, it should be noted that other anions, including those mentioned hereinbefore, can also be used.

PREPARATION OF COMPOUNDS

The quaternary ammonium salts of the examples were prepared by reacting substituted benzyl chlorides with dimethyloctadecylamine

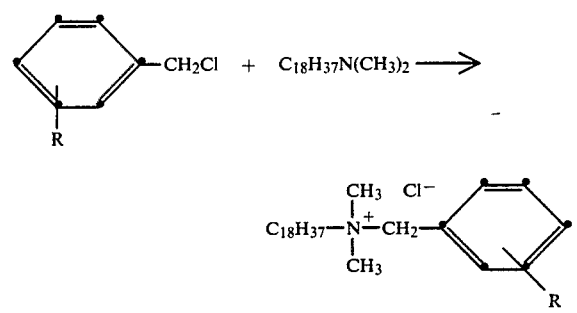

where R was —p—$NO_2$, —m—$CF_3$, —p—Cl, —p—$CH_3$ or —H. Dimethyloctadecylamine, P-nitrobenzyl chloride and all solvents were obtained from Eastman Kodak. p-Chlorobenzyl chloride, α-chloro-p-xylene, and α′-chloro-α,α,α-triflouro-m-xylene were purchased from Aldrich Chemical, Milwaukee, Wisconsin. Benzyldimethyloctadecylammonium chloride monohydrate was obtained from Onyx Chemical under the trade name Ammonyx-4002 ®.

Equimolar amounts of dimethyloctadecylamine and the substituted benzyl chloride were stirred in refluxing anhydrous $CH_3CN$. The solid which formed upon cooling was collected by filtration and washed with diethyl ether. The product was further purified by repeated recrystallization from an appropriate solvent system until its integrated $^1H$ NMR spectra (recorded on a Varian 390 instrument) and chemical analyses were consistent with theory.

EXAMPLE 1

The following example compares the thermal stability of three N-benzyl quaternary ammonium salts in which the benzyl ring contains an electronegative substituent (p—$NO_2$, m—$CF_3$ and p—Cl) to two salts, one in which the benzyl ring contains an electropositive substituent (p-$CH_3$) and the other contains a neutral substituent (H). The anion in each salt is chloride. The electronegativity of a substituent is determined by correlating the chemical shift (δ) of the benzyl methylene protons to the Hammett substituent constant (σ), as described herein. Thus benzyl ring substituents with values of δ for the benzyl methylene protons which are greater than that observed for the unsubstituted benzyl ring (substituent=H) are more electronegative than H, and substituents with values of δ less than that observed for H are less electronegative than H. (See FIG. 1.) All compounds were prepared as described herein.

The chemical shifts are then correlated with the decomposition temperature, as determined by thermal gravimetric analyses (TGA) (measured on a DuPont 1090 thermal analyzer equipped with a 951 thermal gravimetric analyzer (10° C./min, air)). A sample of known weight is placed in the thermal analyzer and its weight is monitored while the temperature is raised at a constant rate, in this case 10° C./min. The temperature at which significant weight loss begins to occur is taken as the decomposition temperature. Pertinent data are summarized in Table I.

Examination of FIG. 1 shows that there is a linear relationship between δ and σ which has the expected positive slope. A more powerful electron withdrawing substitutent (higher σ) causes a reduction in electron density at the benzyl position. This deshields the protons and causes a downfield shift (larger δ).

Figure 2:
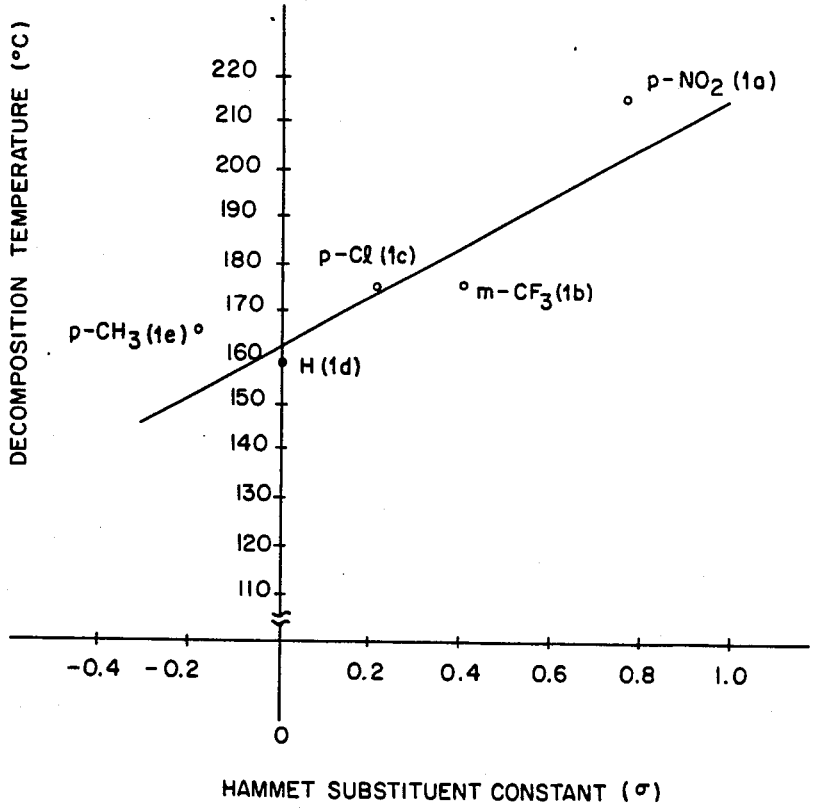
FIG. 2 is a graph which compares substituent constants to decomposition temperatures of N-benzyl quaternary ammonium salts.

A reduction in electron density at that position should also destabilize the incipient carbonium ion and thus inhibit its formation. A comparison of the substituent constants with the decomposition temperature for the compounds shows that this is indeed the case (FIG. 2). The p—$NO_2$ derivative (1a) displays the largest chemical shift as well as the highest degree of thermal stability. The m—$CF_3$ and p—Cl derivatives (1b and 1c), exhibit intermediate chemical shifts and decomposition temperatures. The p—$CH_3$ derivative (1e) shows the smallest shift and the lowest decomposition temperature.

TABLE I

| Compound | Benzyl Substituent | NMR[a] | Decomp. Temp. | Substituent Constant |
|---|---|---|---|---|
| 1a | p-$NO_2$ | 5.50 | 215° | +0.78 |
| 1b | m-$CF_3$ | 5.36 | 175° | +0.43 |
| 1c | p-Cl | 5.21 | 175° | +0.23 |
| 1d | H | 5.13 | 160° | 0.0 |
| 1e | p-$CH_3$ | 4.99 | 165° | −0.17 |

[a]Chemical shift (δ) of the benzyl methylene protons in ppm downfield from internal TMS in $CDCl_3$ solution.

EXAMPLE 2

The following example illustrates the triboelectric and charging characteristics of toners of the present invention (1a'c) when compared to a toner with no charge-control agent and a toner with a prior art charge-control agent (1d) (control). The polymeric binder was styrene-butylacrylate copolymer, and the toners were prepared as described in Example 1 of U.S. Pat. No. 4,394,430 except that the charge-control agents 1a–d were used, as indicated in Table II. The charge to mass ratio was measured on a MECCA device. The results are listed in Table II. (See U.S. Pat. No. 4,496,643 for a discussion of typical charge and throw-off measurement techniques.)

TABLE II

| Charge Control Agent | Conc. (pph) | MECCA Q/M (μcoul/g) |
|---|---|---|
| none | — | 14.9 |
| 1d (control) | 1.0 | 27.5 |
| 1a (p-$NO_2$) | 0.5 | 20.4 |
| 1a (p-$NO_2$) | 1.0 | 24.7 |
| 1a (p-$NO_2$) | 2.0 | 30.6 |
| 1b (m-$CF_3$) | 1.0 | 49.0 |
| 1c (p-Cl) | 1.0 | 46.1 |

As can be seen from these results, the charge to mass ratio improves upon addition of a charge-control agent used in the practice of the present invention when compared to a toner with no charge-control agent. In addition, the charge to mass ratio of toners of the present invention were similar to, and in some cases higher than that possessed by a prior art toner containing a more thermally labile charge control agent (1d).

EXAMPLE 3

The following example compares developer compositions of the present invention to a prior art developer composition. The toners of the present invention included charge-control agents 1a–c and the prior art toner contained charge-control agent 1d. The toners were prepared as described in Example 1 except a polyester was used instead of styrene-butyl-acrylate-divinylbenzene copolymer. The toners were mixed with a ferrite carrier at 13% toner concentration. The developer was shaken for two minutes and the charge to mass ratio was measured with a MECCA device and by a film blowoff technique. The throwoff (in miligrams) was also measured.

TABLE III

| Charge Agent | Conc. (pph) | Film Blow off (μcoul/g) | MECCA Q/M (μcoul/g) | Throw-Off (mag) |
|---|---|---|---|---|
| none | 0.00 | 11.3 | 26.0 | 1.4 |
| 1d (control) | 0.25 | 8.5 | 18.7 | 1.5 |
| 1d | 0.50 | 6.3 | 19.4 | 2.3 |
| 1d | 1.00 | 6.5 | 15.4 | 1.2 |
| 1d | 1.50 | 7.6 | 16.8 | 0.8 |
| 1d | 2.00 | 9.4 | 20.4 | 1.4 |
| 1a | 0.25 | 9.6 | 21.2 | 1.4 |
| 1a | 0.50 | 8.0 | 17.1 | 1.9 |
| 1a (p-$NO_2$) | 1.00 | 9.0 | 18.7 | 1.4 |
| 1a | 1.50 | 8.9 | 20.7 | 1.1 |
| 1a | 2.00 | 9.9 | 23.1 | 1.5 |
| 1b | 0.25 | 2.9 | 11.4 | 9.5 |
| 1b | 0.50 | 3.8 | 13.2 | 5.9 |
| 1b (m-$CF_3$) | 1.00 | 5.7 | 14.9 | 2.6 |
| 1b | 1.50 | 7.6 | 18.0 | 1.7 |
| 1b | 2.00 | 9.3 | 21.5 | 1.4 |
| 1c | 0.25 | 2.5 | 10.8 | 15.2 |
| 1c (p-Cl) | 0.50 | 3.1 | 10.5 | 7.3 |
| 1c | 1.00 | 5.1 | 14.1 | 3.0 |
| 1c | 1.50 | 6.2 | 17.4 | 2.2 |
| 1c | 2.00 | 7.1 | 18.0 | 1.4 |

The above data indicates that the charge to mass ratios for (p-nitro)benzyldimethyloctadecylammonium chloride are similar over a wide range of concentrations.

Although the invention has been described in considerable detail with particular reference to certain preferred embodiments thereof, variations and modifications can be effected within the spirit and scope of the invention.

What is claimed is:

1. A dry, particulate, electrostatic toner composition comprising (a) a polymeric binder, and (b) a charge-control agent comprising an N-benzyl quaternary ammonium salt, wherein the benzyl ring contains at least one substituent with a Hammett substituent constant that is greater than zero.

2. A dry, particulate, electrostatic toner composition comprising (a) a polymeric binder, and (b) a charge control agent comprising quaternary ammonium salt having the formula:

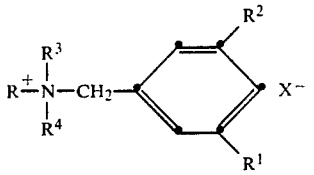

wherein $X^-$ is an anion,

R is hydrogen, a straight or branched chain alkyl group having 12 to 24 carbon atoms, an aryl group or a substituted aryl group;

$R^1$ is any substituent with a Hammett substituent constant that is greater than zero;

$R^2$ is H or any substituent with a Hammett substituent constant that is greater than zero;

$R^3$ and $R^4$, which may be the same or different, are alkyls containing from 1 to 5 carbon atoms; or, when taken together, R, $R^3$ and $R^4$ form a ring system.

3. A composition according to claim 2 wherein $R^1$ is $NO_2$, CN, $CF_3$, $CH_3CO$ or halide.

4. A composition according to claim 1 wherein the polymeric binder also has a colorant dispersed therein.

5. A composition according to claim 1 wherein said polymeric binder has a softening temperature from 65° C. to 200° C.

6. A composition according to claim 2 wherein R is octadecyl.

7. A composition according to claim 1 wherein the toner contains from 0.05 to 2 percent by weight of said quaternary ammonium salt.

8. A composition according to claim 1 wherein said quaternary ammonium salt is (p-nitro)benzyldimethyloctadecylammonium chloride.

9. A dry, particulate, electrostatic toner composition comprising (a) a polymeric binder, (b) a pigment or dye stuff, and (c) from about 0.05 to about 2 percent by weight of a charge-control agent comprising an N-benzyl quaternary ammonium salt, wherein the benzyl ring contains at least one substituent with a Hammett substituent constant that is greater than zero.

10. A dry, particulate electrostatic toner composition comprising (a) a polymeric binder, (b) a pigment or dye stuff in an amount sufficient to color the particles, and (c) from about 0.05 to about 2 percent by weight of a quaternary ammonium salt of the formula:

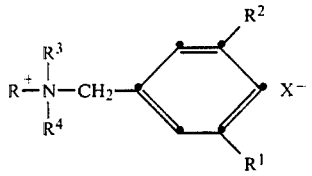

wherein $X^-$ is an anion,

R is hydrogen, a straight or branched chain alkyl group having 12 to 24 carbon atoms, an aryl group or a substituted aryl group;

$R^1$ is any substituent with a Hammett substituent constant that is greater than zero;

$R^2$ is H or any substituent with a Hammett substituent constant that is greater than zero;

$R^3$ and $R^4$, which may be the same or different, are alkyls containing from 1 to 5 carbon atoms; or, when taken together, R, $R^3$ and $R^4$ form a ring system.

11. An electrostatic developer composition comprising (a) carrier particles, and (b) toner particles which are electrostatically attractable to said carrier particles, said toner particles having the composition defined in claim 1.

12. A composition according to claim 1 wherein the polymeric binder is styrene-butyl-acrylate copolymer, polyester, polycarbonate or polyamide.

13. A developer according to claim 11 wherein the toner contains 0.05 to 2 parts by weight of said quaternary ammonium salt and 2 to 8 parts by weight of carbon black per 100 parts of polymeric binder.

14. A method for developing latent images which comprises forming an electrostatic latent image on an imaging member, contacting the resulting image with a developer composition comprised of toner particles having the composition defined in claim 1, followed by transferring the image to a suitable substrate and permanently affixing the image thereto.

* * * * *